US009077074B2

(12) United States Patent
Miyagawa et al.

(10) Patent No.: US 9,077,074 B2
(45) Date of Patent: Jul. 7, 2015

(54) ANTENNA WRAPPED AROUND TO SPEAKER LID

(71) Applicant: BlackBerry Limited, Waterloo (CA)

(72) Inventors: Ryotaro Miyagawa, Kanata (CA); Kevin Edward Booth, Ottawa (CA)

(73) Assignee: BlackBerry Limited, Waterloo, Ontario (CA)

( * ) Notice: Subject to any disclaimer, the term of this patent is extended or adjusted under 35 U.S.C. 154(b) by 277 days.

(21) Appl. No.: 13/649,904

(22) Filed: Oct. 11, 2012

(65) Prior Publication Data

US 2014/0104113 A1 Apr. 17, 2014

(51) Int. Cl.
*H01Q 1/24* (2006.01)
*H01Q 1/36* (2006.01)

(52) U.S. Cl.
CPC ..... *H01Q 1/36* (2013.01); *Y10T 29/49016* (2015.01); *H01Q 1/243* (2013.01)

(58) Field of Classification Search
CPC ..... H01Q 1/36; H01Q 1/243
USPC ..... 343/702; 29/600
See application file for complete search history.

(56) References Cited

U.S. PATENT DOCUMENTS

| | | | | |
|---|---|---|---|---|
| 6,460,773 | B1 | 10/2002 | Kaiya et al. | |
| 7,193,578 | B1 | 3/2007 | Harris et al. | |
| 7,595,219 | B2 | 9/2009 | Ishikawa et al. | |
| 8,051,550 | B2 | 11/2011 | Cheng et al. | |
| 2006/0089184 | A1 * | 4/2006 | Kim et al. | 455/575.5 |
| 2009/0174612 | A1 | 7/2009 | Ayala et al. | |
| 2011/0102272 | A1 | 5/2011 | Wong et al. | |
| 2011/0316751 | A1 | 12/2011 | Jarvis et al. | |
| 2012/0068888 | A1 | 3/2012 | Tsung-Wen et al. | |
| 2012/0100817 | A1 | 4/2012 | Schachar et al. | |
| 2012/0176754 | A1 | 7/2012 | Merz et al. | |

FOREIGN PATENT DOCUMENTS

| | | | |
|---|---|---|---|
| EP | 2 296 222 | A1 | 7/2010 |
| WO | 2011/101534 | A1 | 8/2011 |

OTHER PUBLICATIONS

Extended European Search Report for corresponding application EP 12188110.6-1811, dated Mar. 27, 2013, pp. 1-8.
European Examination Report; Application No. 12188110.6; Apr. 28, 2015; 8 pages.

* cited by examiner

*Primary Examiner* — Dieu H Duong
(74) *Attorney, Agent, or Firm* — Conley Rose, P.C.; J. Robert Brown, Jr.

(57) ABSTRACT

An antenna includes a first portion and a second portion soldered together. The first portion includes conductive traces applied to a first device part. The conductive traces may wrap from one side of the first device part to another side. A second device part is attached to the first device part to enclose a speaker. The second portion of the antenna comprises FPC attached to the second device part. A section of the FPC portion of the antenna extends beyond an edge of the second part and folds over onto solder applied to a section of first portion of the antenna on the first device part. The solder may be melted to attach the first portion of the antenna on the first device part to the second portion of the antenna on the second device part.

20 Claims, 10 Drawing Sheets

ANTENNA WRAPPED AROUND TO SPEAKER LID

BACKGROUND OF THE INVENTION

1. Technical Field

This system relates to a mobile device antenna, and more particularly, to wrapping a first portion of an antenna from a first part of the mobile device to a second portion of the antenna on a second part of the device.

2. Related Art

Some wireless devices have antenna traces integrated onto a portion of the device casing. For example, structured metallization may be applied on a molded plastic device part which may form an antenna. Laser direct structuring technology is one form of plating which may utilize a thermoplastic material doped with a metal-plastic additive. A laser beam may be applied to the plastic along a track corresponding to the antenna trace which may form a region activated for subsequent metallization. In a copper bath, conductor path layers may form on the disposed tracks. In a similar way, additional layers of copper, nickel and/or gold finish may be added.

SUMMARY

A method for making an antenna for a wireless communication device may comprise plating conductive traces on a first device part. The conductive traces may form a first portion of an antenna. The conductive traces may bend or curve from one portion of the first device part to a second portion of the first device part. A second device part may be attached to the first device part. A flexible printed circuit (FPC) may be attached to the second device part. The flexible printed circuit may form a second portion of the antenna. A section of the flexible printed circuit may extend beyond an edge of the second device part. Solder may be applied to a section of the conductive traces on the first device part. The section of the flexible printed circuit that extends beyond the edge of the second device part may be folded. The folded section of the flexible printed circuit that extends beyond the edge of the second device part may overlap the applied solder on the section of the conductive traces on the first device part where the solder is applied. The solder may be melted to attach the first portion of the antenna which is formed by plating conductive traces on the first device part, to the second portion of the antenna which is formed by attaching the flexible printed circuit to the second device part. In this manner, structures within the wireless communication device utilized for the antenna may be reduced and antenna performance may be improved. In some systems the method may improve audio or speaker performance.

Other systems, methods, features, and advantages will be, or will become, apparent to one with skill in the art upon examination of the following figures and detailed description. It is intended that all such additional systems, methods, features, and advantages be included within this description, be within the scope of the disclosure, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the disclosure.

Moreover, in the figures, like referenced numerals designate corresponding parts throughout the different views.

DETAILED DESCRIPTION OF THE PREFERRED EMBODIMENTS

Figure 1:
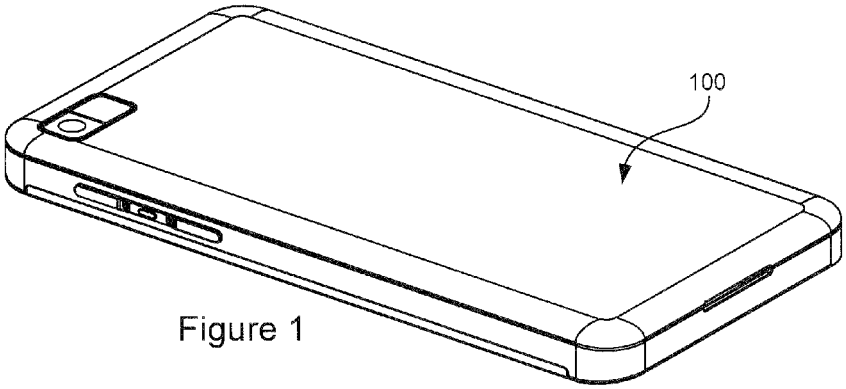
FIG. 1 is a view of the back of a wireless device.

In some systems an antenna may span across multiple separate parts of a wireless device. One portion of the antenna may be formed by metal plating on a first device part. Another portion of the antenna which may be made from a flexible circuit may be attached to a second device part. The two portions of the antenna on the two device parts may be attached together by soldering. The flexible circuit portion of the antenna may wrap around from the second device part onto the first device part and may be soldered to the metal plating of the antenna portion on the first device part. The use of metal plating for at least one portion of the antenna may enable a reduction in thickness or a reduction in surface area of a launching structure for the antenna. By soldering the separate antenna parts together rather than attaching them by spring clip, overall device size may be reduced, antenna performance may be improved and/or audio performance may be improved.

In an exemplary system, parts for a wireless device may include an inner housing part and a speaker lid part. The one or more sides of the inner housing part may be plated with a conductive material in a pattern to form a first portion of an antenna. The plated pattern may wrap and/or bend from one side onto one or more other sides of the inner housing part. A speaker unit may be installed on the inner housing part and may be covered with the speak lid part. The speaker lid part may be attached to the inner housing part, for example, by ultrasonic welding or optical glue to enclose the speaker by the inner housing part and the speaker lid part.

A second portion of the antenna may comprise a flexible printed circuit (FPC) and may be attached to the speaker lid part, for example, by adhesive tape. A tab of the FPC second portion of the antenna may extend beyond the speaker lid part at the edge of the side of the inner housing part near to the place where the metal plate first antenna portion wraps from the back onto the side of the housing. Solder paste may be printed on the metal plating of the first portion of the antenna near the FPC tab extension. The FPC tab may be folded and/or wrapped from the speaker lid onto the solder paste on the side of the inner housing part, and heated to connect the metal plated first portion of the antenna to the FPC second portion of the antenna. The solder paste may be melted by placing a jig or metal piece on soldering points of the antenna. In this manner, the antenna comprising the first conductive plating portion and the second FPC portion may be bent in at least two places and attached to form the antenna. In some systems, depending on the geometry of different device parts and a manner in which the metal plating portion of an antenna is patterned and/or wrapped on a first device part, one or more bends or curves may occur in one of the portions of the antenna while the other portion of the antenna on a second device part, may be flat or may have one or more bends or curves. For example, metal plating of a first portion of an antenna may wrap onto at least three sides of a molded plastic first part of a device and may be attached to a flat FPC portion of the antenna which may be attached to a second part of the device. Similarly, the FPC portion of an antenna on a first device part may be bent in one or more places and may be attached to a flat metal plated portion of the antenna on a second device part.

FIG. 1 is a view of the back of an exemplary wireless device 100. The wireless device 100 may be any suitable device that may be operable to communicate via one or more antennas. The wireless device 100 may be operable to communicate utilizing one or more types of wireless technology, for example, wireless technologies utilized in cellular, satellite, wide area network, local area network and/or personal area network technologies. However, the wireless device 100 is not limited to communicating based on any specific types of wireless technology and may be operable to communicate via any suitable wireless, wired and/or optical technologies. The wireless device 100 may comprise one or more antennas that may be operable to transmit and/or receive signals within any one or more suitable licensed and/or unlicensed frequency bands.

The wireless device 100 may be operable to perform any suitable function or application in addition to wireless communication and is not limited in this regard. For example, the wireless device 100 may be operable to process multi-media applications, voice processing, data processing, gaming, geo-location; remote sensing, emergency services and security functions. The wireless device may comprise a plurality of input sensors and/or output technologies, for example, mechanical or electronic keys, display, speakers, touch screen, pressure sensor or microphone. The wireless device 100 is not limited in this regard.

In some systems the wireless device 100 may be a mobile phone, such as a smart phone that may be operable to communicate based on one or more wireless technologies. For example, the wireless device 100 may be operable to communicate based on 4G Long Term Evolution (LTE) and/or other wireless technologies. In this regard, the one or more antennas of the wireless device 100 may be operable to transmit and/or receive signals in any suitable licensed or unlicensed frequency band. In some systems the one or more antennas may be an antenna which is operable to transmit and/or receive signals within one or more LTE frequency ranges. In some systems, the one or more antennas may be operable to transmit and/or receive signals in frequency bands suitable for one or more of a plurality of wireless communication technologies, for example, any suitable 3GPP, 3GPP2, 802.11, 802.16 or GPS wireless technologies. However, the one or more antennas are not limited to any specific frequency bands. The one or more antennas may be a single antenna or a plurality of antennas and may be referred to as the antenna 102 (shown in FIG. 11). Portions of the antenna 102 may be flat for example, may cover a relatively flat portion of a device part. Portions of the antenna 102 may be bent and/or curved in one or more places. For example, portions of the antenna 102 may wrap or curve around a device part or may comprise an origami fold. In some systems, the configuration of the bent or curved antenna may enable resonance in multiple frequency bands; however, the antenna 102 may not be limited in this way.

The wireless device 100 may comprise the antenna 102 which may have a first portion 410 (shown in FIG. 11) made of conductive traces plated onto a first device part and a second portion 610 (shown in FIG. 11) made of flexible printed circuit (FPC) attached to a second device part. The first portion 410 and the second portion 610 may be soldered together to form the antenna 102. The first portion 410 is further described with respect to FIGS. 3-11. The second portion 610 is further described with respect to FIGS. 6-12. In some systems, the first device part and the second device part may be an inner housing part 400 (or 300) and a speaker lid part 620 described with respect to FIGS. 3-11.

Figure 2:
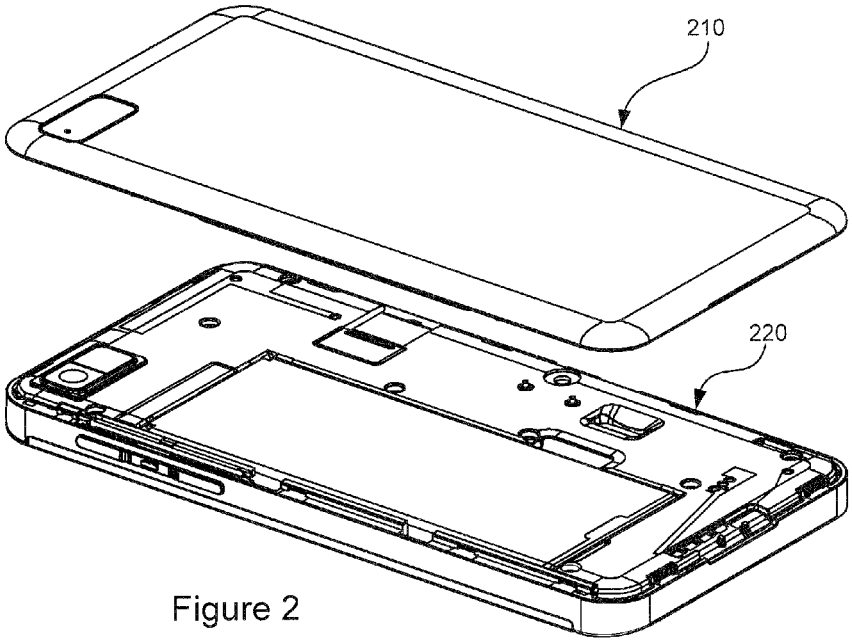
FIG. 2 is an exploded view of the back of a wireless device with a back cover separated from the device.

In some systems, the first portion of the antenna 102 may bend or wrap from a first side of the first device part to a second side of the first device part. In some systems, the second portion of the antenna 102 may bend from the second device part and may extend over a side of the first device part in a location where the first device part is plated with the first portion of the antenna 102 and the extension may be soldered to the first portion of the antenna 102. In this manner the antenna 102 may comprise two origami folds or may bend and/or curve in two places, for example, one bend may occur in the first portion of the antenna 102 and one bend may occur in the second portion of the antenna 102 and the two portions of the antenna 102 may be soldered between the bends. In some systems, the antenna 102 may be operable to support transmission and/or reception in one or more LTE frequency ranges and/or in other frequency ranges FIG. 2 is an exploded view of the back of the wireless device 100 including a back cover 210 separated from one or more other portions 220 of the wireless device 100. The one or more other portions of the device 220 may comprise an inner housing part and/or a battery.

Figure 3:
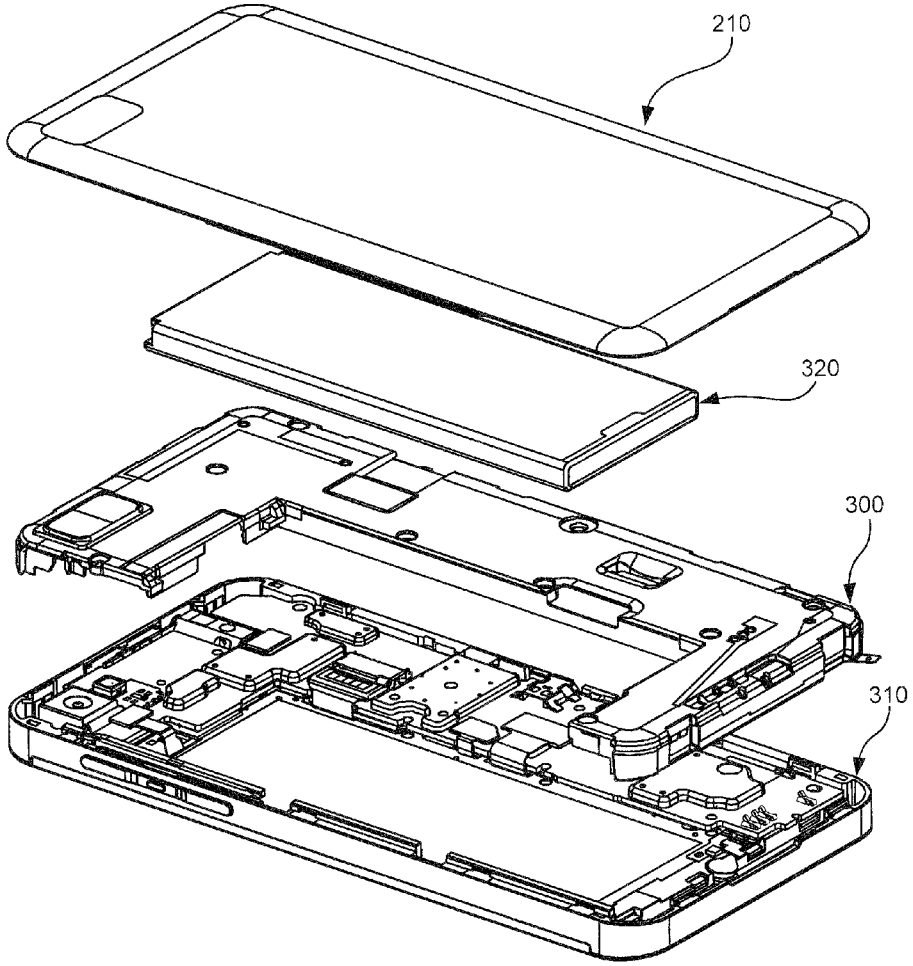
FIG. 3 is an exploded view of the back of a wireless device with separated back cover, battery and inner housing part.

FIG. 3 is an exploded view of the back side of the wireless device 100 including the back cover 210, a battery 320 and an inner housing part 300 separated from other parts 310 toward the front of the wireless device 100. The inner housing part 300 may be similar or substantially the same as the inner housing part 400 described with respect to FIGS. 4-13. In an exemplary system, the inner housing part 300 may be relative to the outer housing part or back cover 210 of the wireless device 100, which may attach to the back of the wireless device 100. The inner housing part 300 may have a back surface 460 and a front surface 470 (shown in FIG. 6). The inner housing part may have side portions which may protrude from the back and front surfaces. The front surface 470 of the inner housing part 300 may extend to inner side surfaces 480. The back surface 460 of the inner housing part may extend in a folded manner to outer side surfaces 450. Conductive plating 410 which may form a first portion 410 of the antenna 102 may be applied to portions of the back surface 460 and/or outer side surfaces 450 of the inner housing part 400, for example. The plating 410 may wrap around from the back surface 460 of the inner housing part 300, to the outer side surface to form an origami bend in the first portion 410 of the antenna 102. A speaker and sub-components 630 may be installed on or above the front surface 470 and/or on or above the inner side surface 480 of the inner housing part 300. A plastic device part 620 which may be separate from the inner housing part 300 and which may be a speaker lid 620, for example, may be attached to the inner housing part 300, for example, by ultrasonic welding or optical glue. The attached speaker lid 620 and the inner housing part 300 may enclose the speaker and sub-components 630 in a sealed air cavity. A flexible circuit second portion 610 of the antenna 102 may be attached to the speaker lid 620. An extended section or a tab 612 (shown in FIG. 11) of the flexible circuit second portion 610 of the antenna may be bent over an outer side 450 of the inner housing part 300 and attached to the conductive plated first portion 410 of the antenna 102. The flexible circuit second portion 610 of the antenna 102 may comprise an origami fold or bend. In this manner, the antenna 102 formed by the attached first 410 and second 610 portions may comprise two origami bends with a length of the antenna 102 between the bends where the two antenna portions 410 and 610 are attached.

Figure 4:
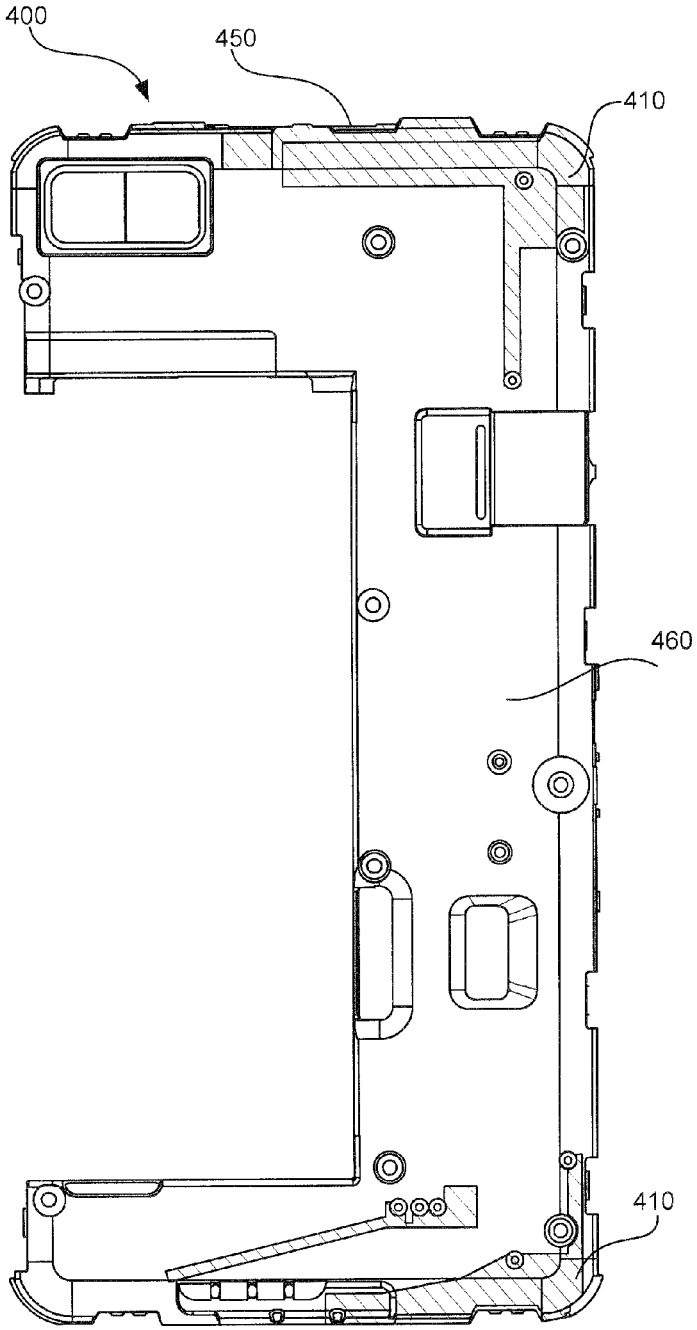
FIG. 4 illustrates a back surface of an inner housing part, with a plated antenna trace pattern comprising a first portion of an antenna.

FIG. 4 is an illustration of a back surface of an inner housing part 400 of the wireless device 100 described with respect to FIGS. 1-3. In some systems, the inner housing part 400 may be similar or substantially the same as the inner housing part 300. The inner housing part 400 may be plated with a conductive trace 410 in a pattern forming the first portion of the antenna 102 (described with respect to FIG. 1) which may be referred to as the first portion 410. Although the system is described with respect to the inner housing part 400, the system is not limited in this regard. For example, the system may be integrated with any suitable inner and/or outer parts of a wireless device.

In an exemplary system, the inner housing part 400 may have a shape with a top (or bottom) and one or more sides where the top (or bottom) and sides meet with curved or angled edges along at least a portion of the perimeter of the top (or bottom). The top (or bottom) of the inner housing part 400 may have a back surface 460, a front surface 470 (shown in FIG. 6), outer side surfaces 450 (also shown in FIG. 6) and an inner side surfaces 480 (shown in FIG. 6). The outer side surfaces 450 may meet the back surface 460 of the inner housing part 400 at an angle or a curve. In some systems, the back surface 460 of the inner housing part 400 may extend in a folded and/or curved manner to the outer side surface 450 of the inner housing part 400. Similarly, the inner side surfaces 480 may meet the front surface 470 at an angle or a curve. In some systems, the inner housing part 400 may be a single molded plastic part. However, the multiple housing or device parts of the present system which are attached to the multiple portions of the antenna 102 may not be shaped like the inner housing part 400 and may have any suitable geometry, for example, with flat, bent or curved surfaces and may be integrated into any suitable kind of object or device. In some instances, the antenna 102 may be remote from other modules or portions of a communicatively coupled wireless device.

Conductive plating which may form the first portion 410 of the antenna 102 may be applied to any of the surfaces of the inner housing part 400 and may be applied in a continuous fashion along and around any of the surfaces including the back surface 460, the front surface 470, the inner side surfaces 480, the outer side surfaces 450 and any edges between the mentioned surfaces. In some systems the conductive plating of the first portion 410 of the antenna 102 may be applied to, at least, the back surface 460 and to the outer side surface 450 of the inner housing part 400. The conductive plating of the first portion 410 of the antenna 102 may wrap around from the back surface 460 to the outer side surface 450. The transition of the conductive plating of the first portion 410 of the antenna 102 from the back surface 460 to the outer side surface 450 may be referred to as a fold, an origami fold, a bend, a curve or a wrap around, for example. In this regard, the first portion 410 of the antenna 102 may comprise at least one fold such that it extends in at least two planes. For example, a first plane may be parallel to the top (or bottom) of the inner housing part 400 and a second plane may be parallel to a side of the inner housing part 400. The first portion 410 of the antenna 102 may be referred to as an antenna trace or conductive plating, for example.

In some systems, the conductive plating of the first portion 410 of the antenna 102 may be made with laser direct structure (LDS) plating onto the inner housing part 400. The inner housing part 400 may be etched by a laser in a pattern designed for the conductive antenna traces of the first portion 410 of the antenna 102. The etched housing may be dipped into a metallic pool to plate the inner housing part 400 on the etched pattern to form the conductive antenna traces of the first portion 410. In some systems the antenna traces may be spray painted such that they are not visible when antenna surface is exposed.

Figure 5:
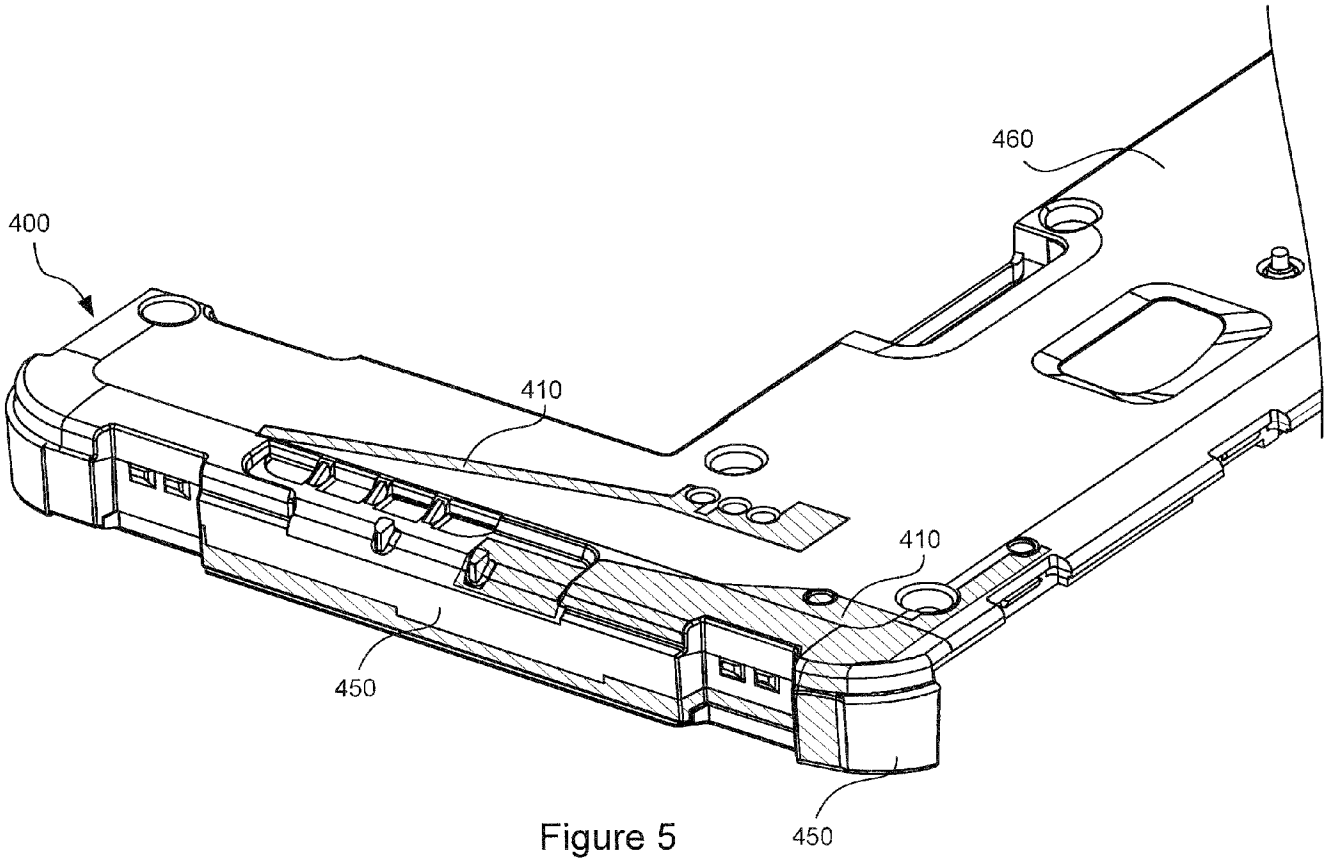
FIG. 5 is a perspective view of back and side surfaces of an inner housing part, with a plated antenna trace pattern comprising a first portion of an antenna.

FIG. 5 is an angle view of back surface 460 and the outer side surfaces 450 of the inner housing part 400 and includes the plated antenna trace of the first portion 410 of the antenna 102. Referring to FIG. 5, the plated antenna trace of the first portion 410 may cover a portion of the back surface 460 of the inner housing part 400 and may bend from the back surface 460 to an outer side surface 450 of the same inner housing part 400.

Figure 6:
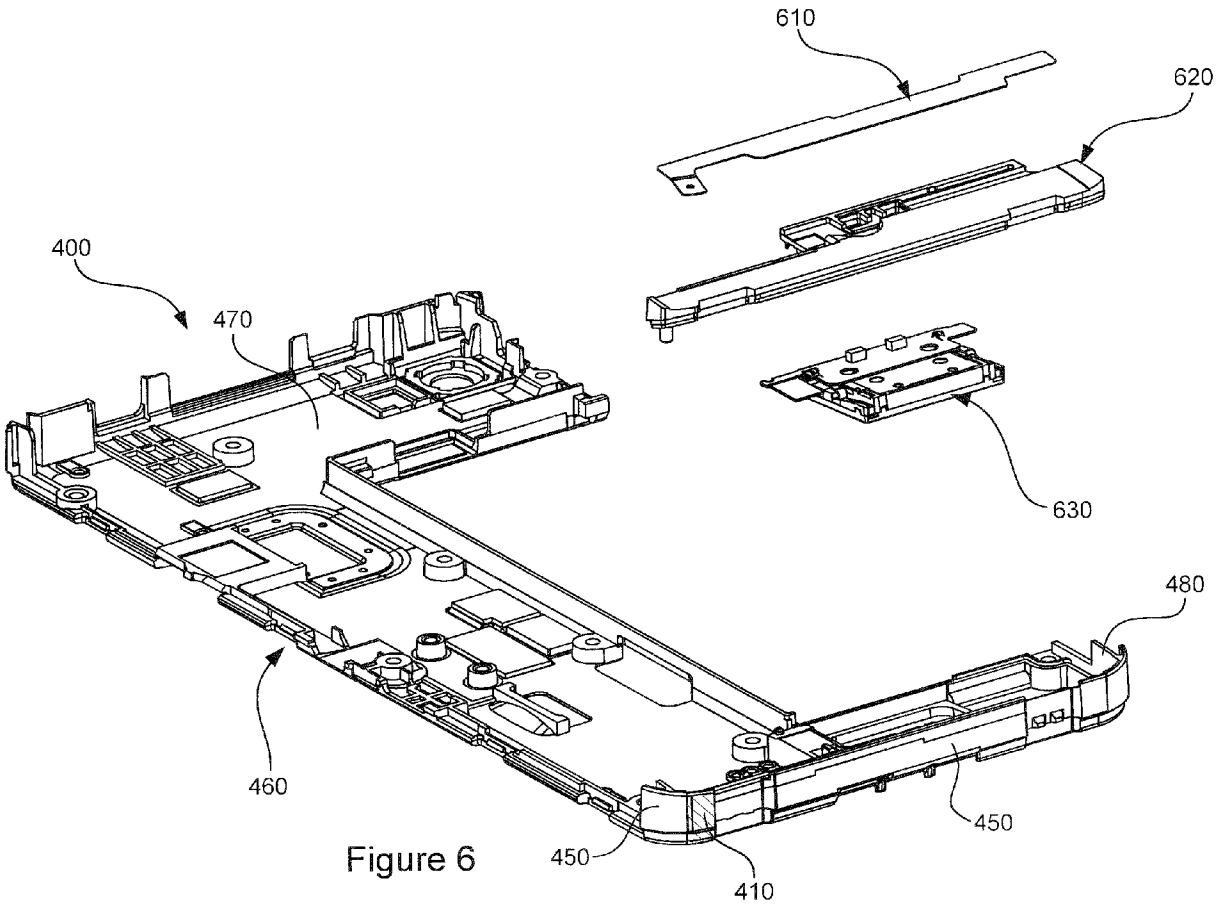
FIG. 6 is a perspective view of front and side surfaces of an inner housing part, a speaker, a speaker lid part and a flexible circuit antenna comprising a second portion of an antenna.

FIG. 6 is an angle view including the front surface 470, the outer side surface 450 and the inner side surface 480 of the inner housing part 400. The plated antenna trace of the first portion 410 of the antenna 102 is shown on the outer side surface 450 of the inner housing part 400. Also shown in FIG. 6 is a component, for example, a speaker unit 630, a second housing part, for example, a speaker lid part 620 and the flexible circuit second portion of the antenna 610 separated from the inner housing part 400. The flexible circuit second portion 610 of the antenna 102 may be referred to as the FPC portion or FPC second portion 610, for example.

Figure 7:
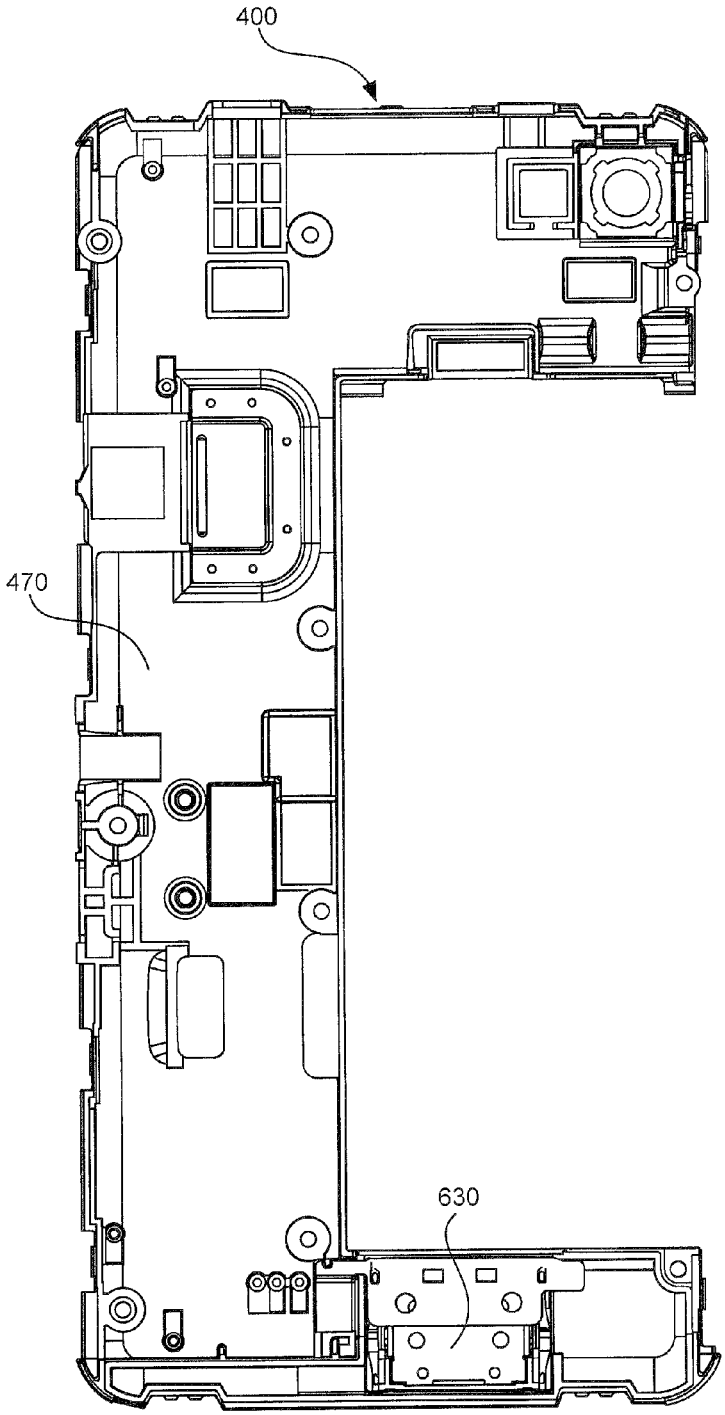
FIG. 7 is an illustration of a front surface of an inner housing part with an installed speaker unit.

The speaker unit 630 may be installed on the inner housing part 400 on the front surface 470. FIG. 7 is an illustration of the front surface of the inner housing part 400 with the speaker unit 630 installed.

The speaker lid part 620 may be installed to cover the speaker unit 630. In some systems, the speaker lid part 620 together with the inner housing part 400 may enclose the speaker unit 630 in a volume of air. The speaker lid part 620 and the inner housing part 400 may be sealed to prevent air leakage from the enclosed volume, for example, the seal may be formed by ultrasonic welding or optical glue.

Figure 8:
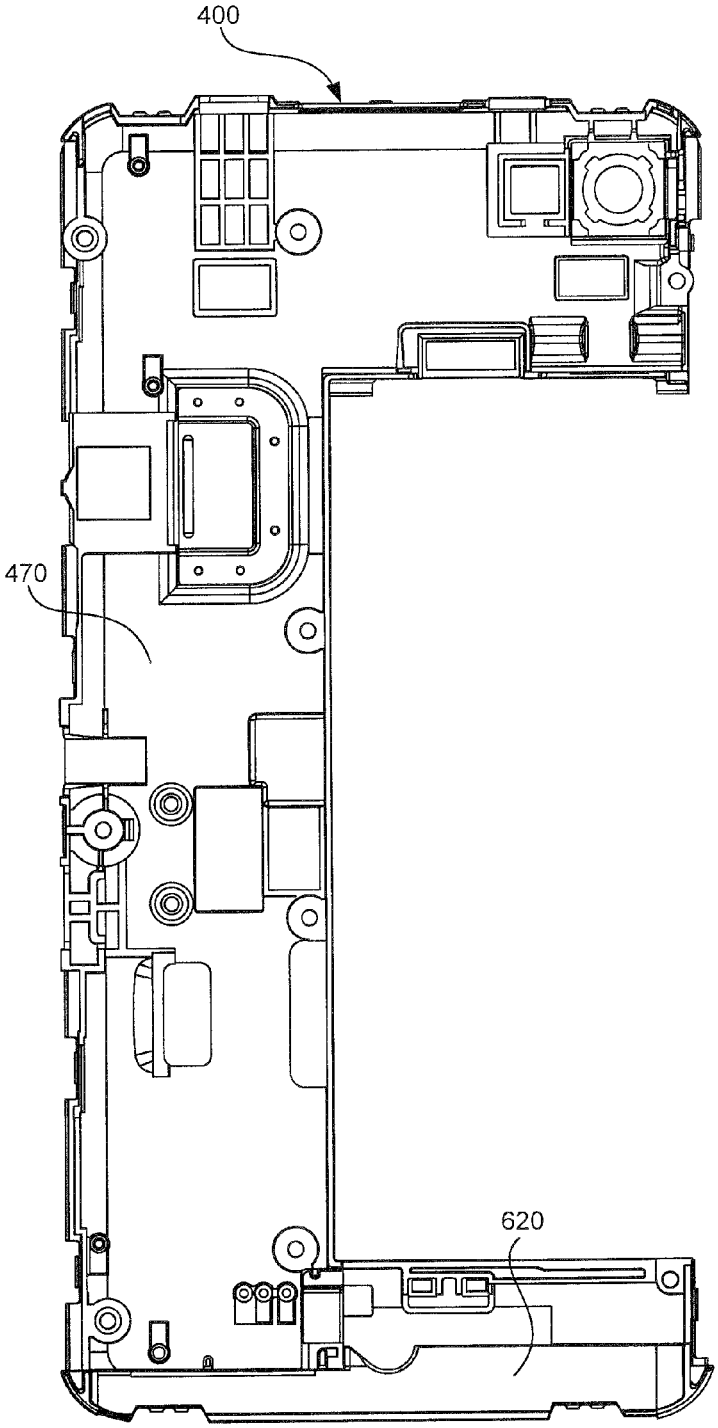
FIG. 8 is an illustration of a front surface of an inner housing part and an installed speaker lid part enclosing a speaker unit.

FIG. 8 is an illustration of the front surface 470 of the inner housing part 400 with the installed speaker lid part 620 enclosing the speaker unit 630.

Figure 9:
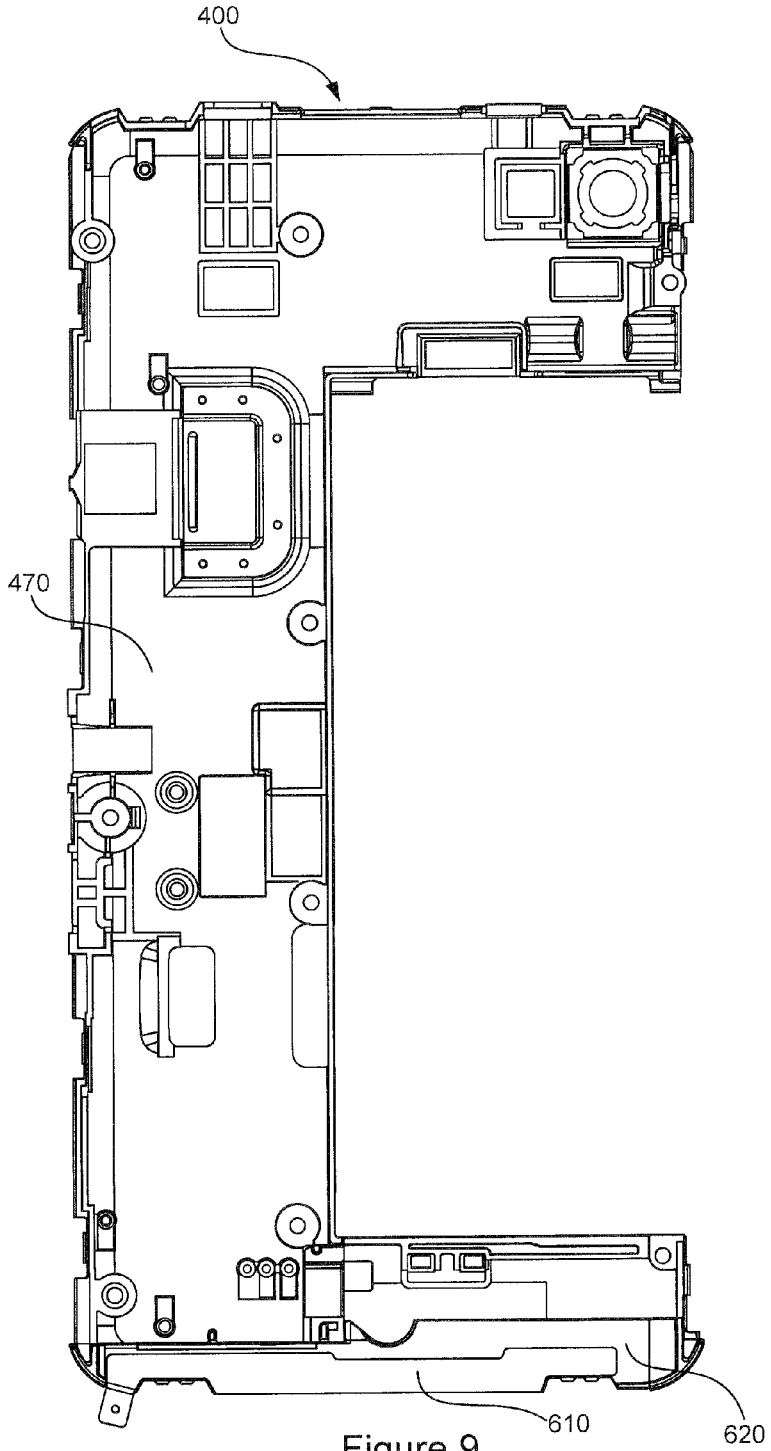
FIG. 9 is an illustration of a front surface of an inner housing part with an installed speaker lid part enclosing a speaker unit, and a second portion of an antenna comprising a flexible circuit attached to the speaker lid part.

FIG. 9 is an illustration of the front surface 470 of the inner housing part 400 with the installed speaker lid part 620 enclosing the speaker unit 630 and the FPC second portion 610 of the antenna 102 attached to the speaker lid part 620. The FPC second portion 610 of the antenna 102 may be attached to the speaker lid part 620, for example, by adhesive tape. However, the invention is not limited with regard to a specific method for attaching the FPC portion of the antenna to the speaker lid part 620. In some systems, the FPC second portion of the antenna 610 may lie flat on the speaker lid. A section or a tab of the FPC second portion 610 of the antenna 102 may extend beyond the edge of the speaker lid part 620 such that it may be bent over a side of the inner housing part 400 and attached to the conductive plated first portion of the antenna 410 on the outer side surface 450 of the inner housing part 400. In this manner, the FPC second portion 610 of the antenna 102 may comprise at least one origami fold or bend. The extended section or tab may be used to attach the FPC second portion 610 of the antenna 102 to the conductive plating first portion 410.

Figure 10:
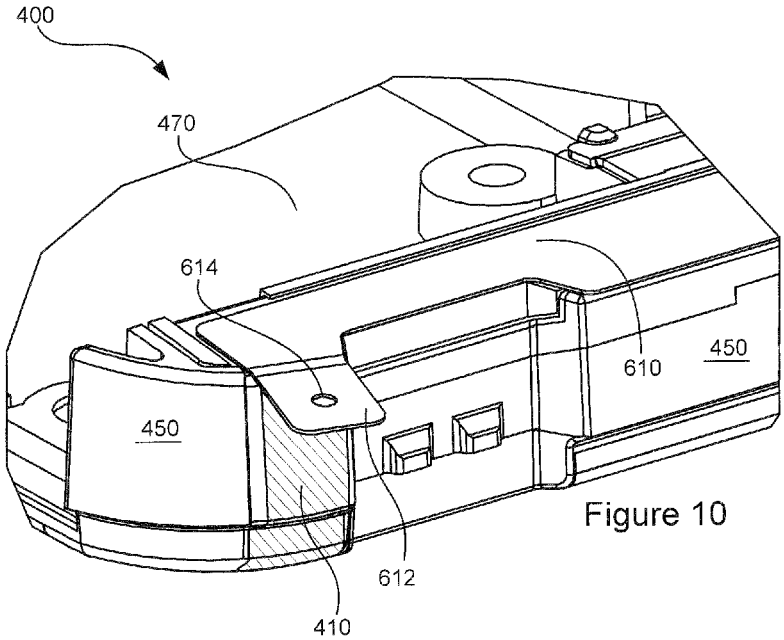
FIG. 10 is a partial perspective view of front and side surfaces of an inner housing part and a second portion of an antenna comprising a flexible circuit attached to a speaker lid part and a foldable portion of the flexible circuit extending beyond an edge of the side surface of the inner housing part.

FIG. 10 is an angle view of the front side 470 and the outer side surface 450 of the inner housing part 400 and the FPC second portion 610 of the antenna 102 attached to the speaker lid part 620 and a foldable section or tab 612 of the FPC second portion 610 extending beyond the edge of the inner housing part 400. The foldable section or tab 612 may comprise one or more via holes 614.

Figure 11:
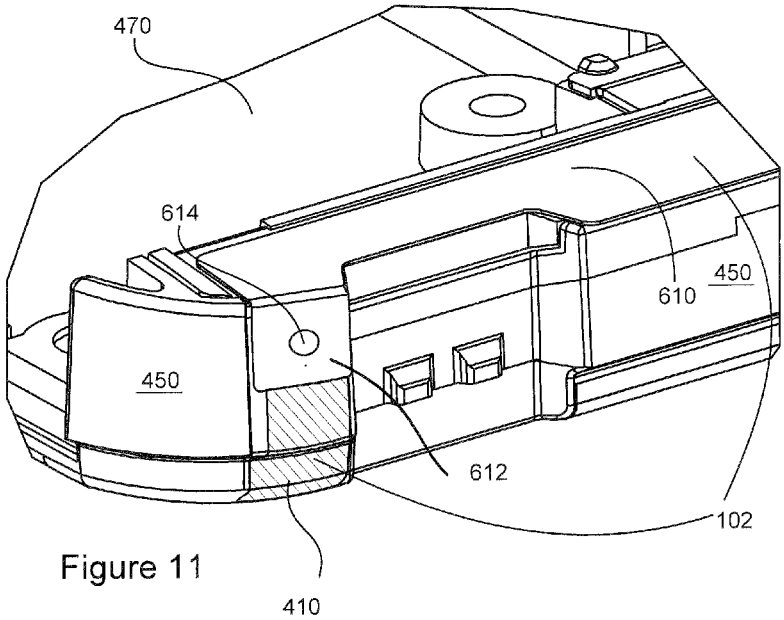
FIG. 11 is a partial perspective view of front and side surfaces of an inner housing part and a second portion of an antenna comprising a flexible circuit attached to a speaker lid part and a foldable portion of the second portion of the antenna, folded and attached onto a plated antenna trace pattern comprising a first portion of the antenna on the side surface of the inner housing part.

FIG. 11 is an angle view of the front surface 470 and the outer side surface 450 of the inner housing part 400. The FPC second portion 610 of the antenna 102 may be attached to the speaker lid part 620 and the foldable section or tab 612 of the FPC second portion 610 may be folded and attached onto the conductive plating of the first portion 410 of the antenna 102 on the outer side surface 450 of the inner housing part 400. In some systems, the FPC second portion 610 of the antenna 102 may be attached to the conductive plating first portion 410 of the antenna 102 by soldering. For example, solder paste may be printed on the conductive plating of the first portion 410 on the inner housing part 400, at the connection area. The FPC second portion 610 may be bent and may land onto the solder paste. In some systems, a heated jig 1300 (shown in FIG. 13) may be pressed onto the FPC portion 610 and may transfer heat to the solder paste to melt the solder and attach or connect the conductive plating portion 410 with the FPC portion 610 of the antenna 102. In some systems, the solder past may require only approximately 0.05 mm of thickness. In some systems, the conductive plating 410 in the connection area may be a flat surface. The connection area of the FPC portion 610 may have a copper or metallic layer exposed. Utilization of solder rather than spring clips to attach the conductive plating to the FPC may save space in the wireless device and may allow for a larger volume air within the speaker unit enclosure while wrapping the antenna 102 around the enclosure. This may improve audio performance in the wireless device.

In some systems, the FPC portion 610 of the antenna 102 in the connection area may comprise one or more via holes and/or micro via holes which may enable the solder to melt though and strengthen the connection between the first portion 410 and the second portion 610. For example, the FPC portion 610 may have one or more via holes of approximately 0.7 mm in diameter and/or a plurality of micro via holes.

Figure 12:
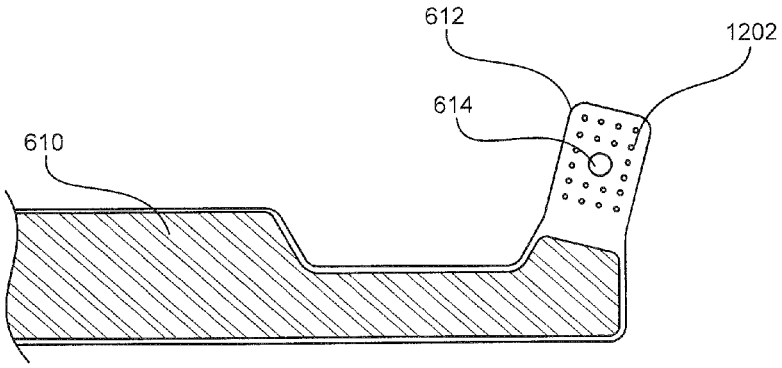
FIG. 12 is an illustration of a flexible circuit second portion of the antenna comprising a foldable portion including a rounded hole and a plurality of micro via holes for improved attachment by solder onto a plated antenna trace pattern comprising a first portion of the antenna on the side surface of the inner housing part.

FIG. 12 is detailed illustration of the flexible circuit portion 610 of the antenna 102 including the section or tab 612. The section or tab 612 may comprise a plurality of holes, for example, a rounded hole 614 and/or a plurality of micro via holes 1202. In an exemplary system, the tab 612 may include the rounded hole 614 with a diameter of about 0.7 mm and twenty micro via holes 1202 with diameters of about 0.2 mm. The hole 614 and/or the micro via holes 1202 may be through plated, where a vertical surface inside of these holes may be conductive and solder may stick well to them. The hole 614 and/or the micro via holes 1202 may help solder to "grab" to the FPC tab 612 with greater strength for improved attachment by solder onto the conductive plating first portion 410. The FPC portion 610 may be folded, for example, at or near the tab 612, over the edge or side of the inner housing part 400 to overlap a section of the conductive plating first portion 410 on the outer surface 450 of the inner housing part 400 as described with respect to FIG. 11.

Figure 13:
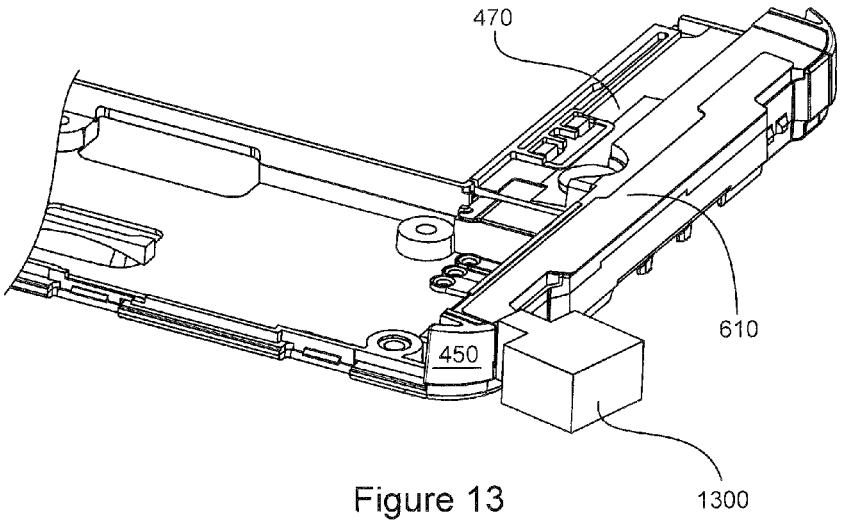
FIG. 13 is an illustration of a jig for soldering a flexible circuit second portion of an antenna to a plated antenna trace comprising a first portion of the antenna.

FIG. 13 is an illustration of a jig 1300 that may be utilized for soldering the flexible circuit second portion 610 to the plated antenna trace comprising the first portion 410 of the antenna 102. As described with respect to FIG. 11, solder paste may be printed onto the conductive plating of the first portion 410 at the connection area of the inner housing part 400. The FPC second portion 610 may be bent and may land onto the solder paste. The jig 1300 may be heated and pressed onto the FPC portion 610 and may transfer heat to the solder paste to melt the solder and attach or connect the conductive plating portion of the 410 of the antenna 102 with the FPC portion 610. In this manner, the antenna 102 may be formed by attaching the first portion 410 with the second portion 610.

The above described systems may be embodied in many technologies and many configurations. While various embodiments of the disclosure have been described, it will be apparent to those of ordinary skill in the art that many more embodiments and implementations are possible within the scope of the disclosure. Accordingly, the disclosure is not to be restricted except in light of the attached claims and their equivalents.

We claim:

1. A method for making an antenna for a wireless communication device, said method comprising:

plating conductive traces on a first device part wherein said conductive traces form a first portion of an antenna and wherein said conductive traces bend from one area of said first device part to a second area of said first device part;

attaching a second device part to said first device part;

attaching a flexible printed circuit (FPC) to said second device part wherein said flexible printed circuit forms a second portion of said antenna and wherein a section of said flexible printed circuit extends beyond an edge of said second device part;

applying solder to a section of said conductive traces on said first device part;

folding said section of said flexible printed circuit that extends beyond said edge of said second device part wherein said folded section of said flexible printed circuit that extends beyond said edge of said second device part overlaps said applied solder on said section of said conductive traces on said first device part where said solder is applied; and melting said solder to attach said first portion of said antenna formed by said plating conductive traces on said first device part to said second portion of said antenna formed by said attaching said flexible printed circuit to said second device part.

2. The method according to claim 1, wherein at least one of said first device part and said second device part is a housing part of said wireless communication device.

3. The method according to claim 1, wherein at least one of said first device part and said second device part is a speaker lid of said wireless communication device.

4. The method according to claim 1, wherein said attaching said second device part to said first device part comprises enclosing a component by at least said first device part and said second device part.

5. The method according to claim 1, wherein said antenna wraps around at least a portion of said first device part and at least a portion of said second device part.

6. The method according to claim 1, wherein said antenna comprises at least one bend or curve in said first portion of said antenna and said antenna comprises at least one bend or curve in said second portion of said antenna.

7. The method according to claim 1, wherein said plating conductive traces on said first device part is performed utilizing laser direct structuring techniques.

8. The method according to claim 1, wherein said section of said flexible printed circuit that extends beyond said edge of said second device part comprises one or more via holes in which said melted solder can flow.

9. The method according to claim 1, wherein one or more of said solder, said folded section of said flexible printed circuit and said section of said conductive traces on said first device part where said solder is applied, are heated in a jig to melt said solder and attach said first portion of said antenna to said second portion of said antenna.

10. The method according to claim 1, wherein said antenna is operable to one or both of transmit and receive signals in one or more frequency bands utilized for Long Term Evolution (LTE) wireless technologies.

11. A system comprising an antenna for a wireless communication device, said system comprises:

plated conductive traces on a first device part wherein said plated conductive traces form a first portion of an antenna and wherein said plated conductive traces bend or curve from one area of said first device part to a second area of said first device part;

a second device part attached to said first device part;

a flexible printed circuit (FPC) attached to said second device part wherein said flexible printed circuit forms a second portion of said antenna and wherein a section of said flexible printed circuit that extends beyond an edge of said second device part is folded and overlaps applied solder on said section of said conductive traces on said first device part; and wherein said solder attaches said first portion of said antenna formed by said plated conductive traces on said first device part to said second portion of said antenna formed by said flexible printed circuit attached to said second device part.

12. The system according to claim 11, wherein at least one of said first device part and said second device part is a housing part of said wireless communication device.

13. The system according to claim 11, wherein at least one of said first device part and said second device part is a speaker lid of said wireless communication device.

14. The system according to claim 11, wherein said second device part attached to said first device part comprises an enclosed component.

15. The system according to claim 11, wherein said antenna wraps around at least a portion of said first device part and at least a portion of said second device part.

16. The system according to claim 11, wherein said antenna comprises at least one bend or curve in said first portion of said antenna and said antenna comprises at least one bend or curve in said second portion of said antenna.

17. The system according to claim 11, wherein said plated conductive traces on said first device part are plated onto said first device part by laser direct structuring techniques.

18. The system according to claim 11, wherein said section of said flexible printed circuit that extends beyond said edge of said second device part comprises one or more via holes in which said solder can flow.

19. The system according to claim 11, wherein one or more of said solder, said folded section of said flexible printed circuit and said section of said conductive traces on said first device part where said solder is applied, are heated in a jig to melt said solder and attach said first portion of said antenna to said second portion of said antenna.

20. The system according to claim 11, wherein said antenna is operable to one or both of transmit and receive signals in one or more frequency bands utilized for Long Term Evolution (LTE) wireless technologies.

* * * * *